US010455332B2

(12) United States Patent
Jensen

(10) Patent No.: US 10,455,332 B2
(45) Date of Patent: Oct. 22, 2019

(54) HEARING AID SYSTEM AND A METHOD OF OPERATING A HEARING AID SYSTEM

(71) Applicant: Widex A/S, Lynge (DK)

(72) Inventor: Lars Baekgaard Jensen, Farum (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 15/428,241

(22) Filed: Feb. 9, 2017

(65) Prior Publication Data

US 2017/0245062 A1 Aug. 24, 2017

(30) Foreign Application Priority Data

Feb. 24, 2016 (DK) ..... 2016 00106

(51) Int. Cl.

| | |
|---|---|
| ***H04R 3/04*** | (2006.01) |
| ***H04R 25/00*** | (2006.01) |
| ***H04R 3/06*** | (2006.01) |
| ***H04R 19/04*** | (2006.01) |
| *H04R 3/00* | (2006.01) |

(52) U.S. Cl.

CPC ..... *H04R 25/356* (2013.01); *H04R 3/06* (2013.01); *H04R 19/04* (2013.01); *H04R 25/00* (2013.01); *H04R 25/305* (2013.01); *H04R 3/00* (2013.01); *H04R 25/505* (2013.01); *H04R 2201/003* (2013.01); *H04R 2225/41* (2013.01); *H04R 2225/61* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,947,432 | A | 8/1990 | Pholm | |
| 2006/0062406 | A1 | 3/2006 | Kinoshita | |
| 2013/0271307 | A1 | 10/2013 | Kropfitsch et al. | |
| 2015/0010157 | A1* | 1/2015 | Doller | H04R 29/004 381/58 |
| 2015/0110312 | A1* | 4/2015 | Mesfin | H04R 25/356 381/312 |

FOREIGN PATENT DOCUMENTS

| | | | |
|---|---|---|---|
| DE | 10 2010 017 959 | A1 | 10/2011 |
| WO | 01/78446 | A1 | 10/2011 |
| WO | 2015/176745 | A1 | 11/2015 |

OTHER PUBLICATIONS

Danish Search Report of Danish Application No. PA 2016 00106 dated Apr. 28, 2016.
PCT Written Opinion dated Apr. 2017, PCT/EP2017/052550.
Mark Schmidt: Musicians and Hearing Aid Design—Is your Hearing Instrument Being Overworked?, Trends in Amplification, vol. 16, No. 3, Sep. 1, 2012, pp. 140-145.

* cited by examiner

*Primary Examiner* — Amir H Etesam
(74) *Attorney, Agent, or Firm* — Sughrue Mion, PLLC

(57) ABSTRACT

A method (300) of operating a hearing aid system (100), wherein the dynamic range of input signal levels is improved by reducing the sensitivity of an input transducer in response to a trigger event while at the same time applying a gain adapted to compensate the reduced sensitivity and a hearing aid system (100, 200) adapted to carry out the method.

20 Claims, 3 Drawing Sheets

HEARING AID SYSTEM AND A METHOD OF OPERATING A HEARING AID SYSTEM

The present invention relates to hearing aid systems. The present invention also relates to a method of operating a hearing aid.

BACKGROUND OF THE INVENTION

Generally a hearing aid system according to the invention is understood as meaning any system which provides an output signal that can be perceived as an acoustic signal by a user or contributes to providing such an output signal, and which has means which are used to compensate for an individual hearing loss of the user or contribute to compensating for the hearing loss of the user or contribute to compensating for the hearing loss. These systems may comprise hearing aids which can be worn on the body or on the head, in particular on or in the ear, and can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a hearing aid may be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear. For this type of traditional hearing aids the mechanical design has developed into a number of general categories. As the name suggests, Behind-The-Ear (BTE) hearing aids are worn behind the ear. To be more precise, an electronics unit comprising a housing containing the major electronics parts thereof is worn behind the ear, and an earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids. In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system, or the external device alone may function as a hearing aid system. Thus within the present context the term "hearing aid system device" may denote a traditional hearing aid or an external device.

It is well known within the art of hearing aid systems that the optimum setting of the hearing aid system parameters may depend critically on the given sound environment. It has therefore been suggested to provide the hearing aid system with a multitude of complete hearing aid system settings, often denoted hearing aid system programs, which the hearing aid system user can choose among, and it has even be suggested to configure the hearing aid system such that the appropriate hearing aid system program is selected automatically without the user having to interfere. One example of such a system can be found in U.S. Pat. No. 4,947,432.

This general concept of automatically selecting the appropriate hearing aid system program requires that any given sound environment can be identified as belonging to one of several predefined sound environment classes. Methods and systems for carrying out this sound classification are well known within the art.

In order to provide the best possible sound quality and speech intelligibility in a hearing aid system it is important that the available dynamic range of the hearing aid system matches the dynamic range of the sound pressure level in the sound environments that a hearing aid system user experiences. However, for some types of microphones and analog-digital converters it is not possible to match the requirements to the available dynamic range in certain sound environments.

It is therefore a feature of the present invention to provide a method of operating a hearing aid system that improves the effective dynamic range of the hearing aid system.

It is another feature of the present invention to provide a hearing aid system adapted to improve the effective dynamic range of the hearing aid system.

SUMMARY OF THE INVENTION

The invention, in a first aspect, provides a method of operating a hearing aid system according to claim 1.

The invention, in a second aspect, provides a hearing aid system according to claim 9.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects, all without departing from the invention.

Accordingly, the drawings and descriptions will be regarded as illustrative in nature and not as restrictive. In the drawings.

DETAILED DESCRIPTION

Within the present context the term dynamic range is construed to mean the dynamic range of input signal levels (i.e. the electrical signal levels that represent the sound pressure levels in the sound environment) that can be processed.

Within the present context the term input transducer is construed to include electronic circuitry that normally is packaged together with the essential parts of the input transducer.

In the following the terms signal and electrical signal may be used interchangeably.

Figure 1:
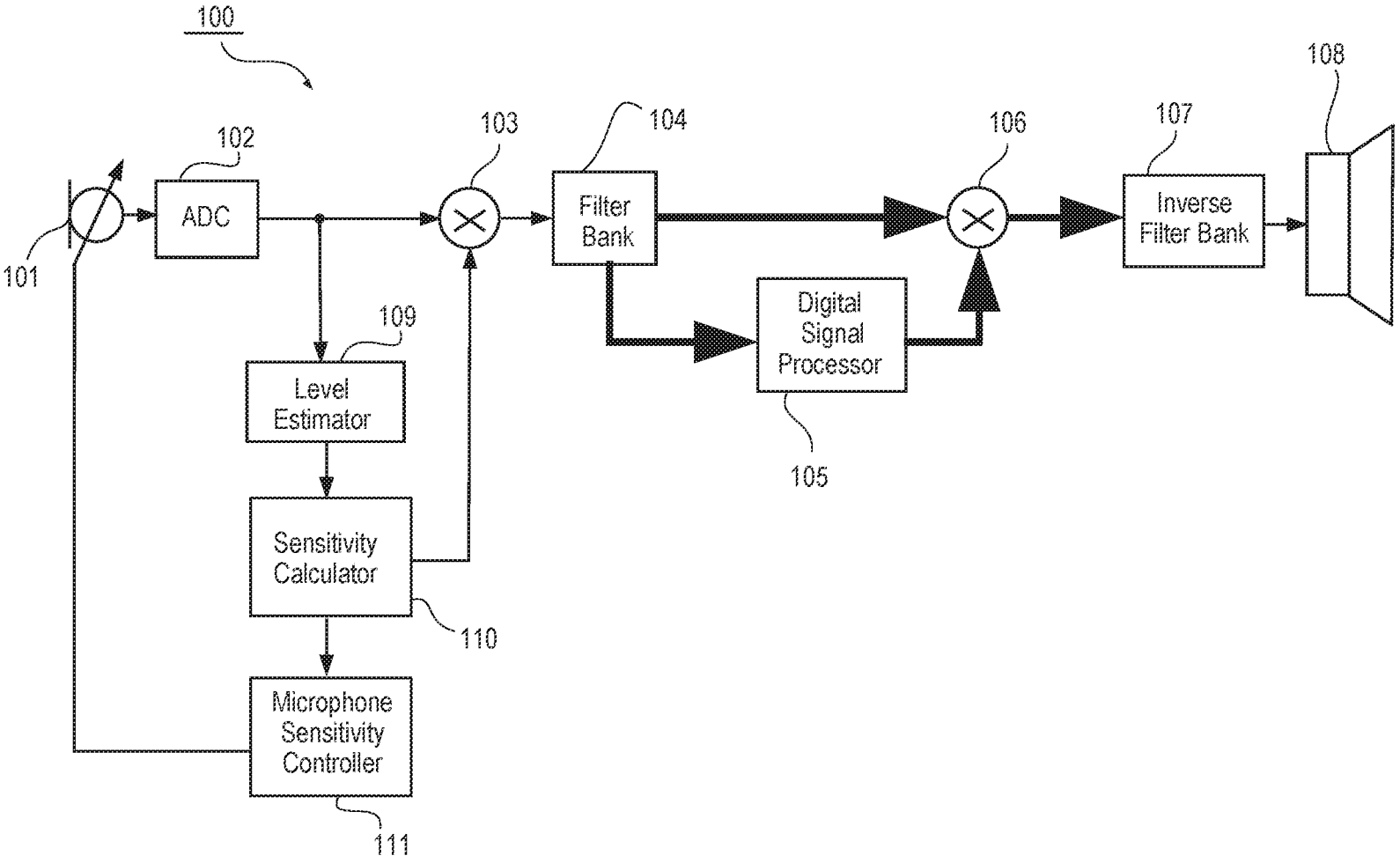
FIG. 1 illustrates highly schematically a hearing aid system according to a first embodiment of the invention.

Reference is first made to FIG. 1, which illustrates highly schematically a hearing aid system 100 according to a first embodiment of the invention. The hearing aid system 100 comprises, an acoustical-electrical input transducer 101 (that in the following may also be denoted a microphone or simply an input transducer), an analog-digital converter 102 (that in the following may be abbreviated ADC), a first gain multiplier 103, a filter bank 104, a digital signal processor 105, a second gain multiplier 106, an inverse filter bank 107, an electrical-acoustical output transducer 108, a level estimator 109, an sensitivity calculator 110 and a microphone sensitivity controller 111.

The microphone 101 provides a broadband analog electrical input signal that is converted to a digital input signal by the ADC 102. The digital input signal from the ADC 102 is branched and provided to both the first gain multiplier 103 and to the level estimator 109. The level estimator 109 provides an estimate of the input signal level, which is subsequently used by the sensitivity calculator 110 to determine whether the input signal fulfills a criterion indicating that the microphone is close to saturation. According to the first embodiment the sensitivity calculator 110 comprises a trigger to determine whether a predetermined threshold input signal level has been exceeded.

According to the first embodiment the threshold input signal level is selected to be 1 dB below the maximum input signal level of the microphone, wherein the maximum input signal level represents the sound level that will saturate the microphone.

In variations of the first embodiment the threshold input signal level may be selected from a range between 0.5 dB and 5 dB below a maximum of the input signal level In other variations the threshold input signal level is not selected in order to avoid saturation of the microphone. Instead the threshold input signal level is selected in order to avoid saturation of the ADC, and in this case the maximum input signal level represents the sound level that will saturate the ADC.

In case the predetermined threshold input signal level has been exceeded the sensitivity calculator 110 determines how much the microphone sensitivity is to be reduced and determines a corresponding compensation gain to be applied to the digital input signal by the first gain multiplier 103, in order to provide a sound output level from the acoustical-electrical output transducer 108 that is independent of the attenuation of the microphone sensitivity. In other words the compensation gain applied by the first gain multiplier 103 provides that the digital signal after the multiplier is independent of the attenuation of the microphone sensitivity.

The microphone sensitivity controller 111, provides the control signal to be applied to the microphone 101 in order to attenuate the microphone sensitivity.

According to the first embodiment the sensitivity of the microphone is controlled by adjusting the polarization voltage, i.e. the voltage between the microphone membrane and back-plate. This is advantageous in so far that a continuous adjustment can be carried out.

Generally, so called capacitive microphones are characterized by having the polarization voltage applied actively, which makes sensitivity control of this type of microphone uncomplicated because the sensitivity controller 111 in this case simply controls the magnitude of an analog voltage that has to be applied anyway. Micro-Electrical-Mechanical-System (MEMS) microphones may be implemented as capacitive microphones. MEMS microphones are relatively inexpensive but generally suffer from a limited dynamic range and may therefore particularly benefit from the present invention by making these microphone types capable of matching the dynamic range offered by other, more expensive microphone types.

However, other types of microphones may be suitable for implementation in a hearing aid system such as microphones of the electret type. Electret microphones are characterized in that an electrical charge is applied to the back-plate and kept fixed there whereby the required polarization voltage is applied passively. It is therefore required to modify the design of this type of microphones in some manner in order to allow the sensitivity to be adjusted.

According to the first embodiment, the sensitivity calculator 110 applies a positive gain of 12 dB to the digital signal provided by the ADC 102, and the microphone sensitivity controller 111 provides that the microphone sensitivity is reduced by the same amount. The effect hereof is that the dynamic range of the sound input level for the hearing aid system 100 is effectively extended by 12 dB. In variations the applied positive gain may be in the range between 5 dB and 20 dB or preferably in the range between 8 dB and 15 dB.

The filter bank 104 splits the broadband digital input signal into a plurality of frequency band signals that are branched and provided both to the second gain multiplier 106 and to the digital signal processor 105, which determines the gains to be applied to the respective frequency bands in order to relieve a hearing deficit of an individual user. The plurality of frequency bands are illustrated by bold lines. In the following the broadband input signal may also simply be denoted input signal, and the frequency band signals may also simply be denoted frequency bands. The determined gains are applied to the frequency bands by the second gain multiplier 106, hereby providing processed frequency bands that are combined in the inverse filter bank 107, wherefrom an output signal is provided to the electrical-acoustical output transducer 108. It is well known for a person skilled in the art that the number of available frequency bands may vary between say 3 and up to say 2048. According to the first embodiment the digital signal processor 105 is adapted to compensate a hearing loss of an individual hearing aid user by providing for each frequency band an appropriate gain as a function of frequency band signal level. This functionality is well known within the art of hearing aid systems, and the term compressor may also be used for a component providing this type of functionality. Furthermore the digital signal processor 105 may be adapted to provide e.g. various forms of noise reduction and speech enhancing features, all of which will be well known for a person skilled in the art.

Thus within the present context an input signal is construed to mean a signal provided from the input transducer. Therefore such a signal may be denoted an input signal until it enters the digital signal processor 105 or until a gain adapted to relieve a hearing deficit is applied by the second gain multiplier 106.

In a variation of the first embodiment the sensitivity calculator 110 is adapted to adjust the input transducer sensitivity and the corresponding compensation gain in response to the input signal level exceeding an adaptive threshold level. Some sound environments may be more likely to provoke saturation of the input transducer or the ADC, and it may therefore be advantageous to implement an adaptive threshold level such that a lower threshold level may be selected in response to a detection (i.e. classification) of these sound environments in order to minimize the risk of sound artefacts due to the requirement to implement relatively drastic changes of the input transducer sensitivity in case of a relatively low difference between the threshold level and the saturation level.

In a variation of the first embodiment the sensitivity calculator 110 is adapted to slowly and continuously adjust the microphone sensitivity and the corresponding compensation gain in response to the input signal level exceeding a predetermined or adaptive threshold level. Hereby possible sound artefacts that may result from a discrete and abrupt change of the microphone sensitivity can be kept at a minimum, because the slow and continuous adjustment of the microphone sensitivity will tend to make any sound artefacts inaudible even if the adjustments of the microphone sensitivity and the compensation gain are not perfectly synchronized.

In further variations the first threshold input signal level may be selected from a range of input signal levels that are much lower than the maximum input signal level that corresponds to the saturation level of the microphone or the ADC. This variation may especially be advantageous in combination with a sensitivity calculator adapted to slowly and continuously adjust the microphone sensitivity and the corresponding compensation gain in response to the input signal level exceeding a predetermined or adaptive threshold level.

According to a further variation the microphone sensitivity is controlled such that a predetermined or adaptive relation between the ambient sound pressure level and the estimated input signal level is obtained. According to yet other variations the predetermined relation between the ambient sound pressure level and the estimated input signal level may take on basically any form that provides a compression of the estimated input signal level relative to the ambient sound pressure level, wherein the ambient sound pressure level may be estimated as the estimated input signal level plus the magnitude of the reduced microphone sensitivity). It follows directly from FIG. 1 that this type of microphone sensitivity control can be carried out by the sensitivity calculator 110 knowing the estimated input signal level from the level estimator 109 and knowing the magnitude of the adjusted microphone sensitivity.

In still another variation of the first embodiment the microphone sensitivity is controlled by a digital pulse train. This is advantageous because it allows the effective microphone sensitivity to be adjusted with a high resolution even in a case where the actual implementation of the microphone only allows control of the sensitivity with a very low resolution, such as a one bit control (i.e. an on or off implementation of the microphone reduction). However, a digital pulse train for controlling the microphone sensitivity may also be advantageous in case the microphone sensitivity is controllable with a continuous analog voltage, or at least controllable with a high resolution, because a digital implementation of the microphone sensitivity controller 111 is advantageous over an analog implementation with respect to price, size and current consumption.

The frequency of the digital pulse train may be in the range of say 100 kHz and 10 MHz as long as the sampling frequency of the ADC is at least twice as high in order to fulfill the Nyquist criterion. Typically the sampling frequency of the ADC is in the range between 1 MHz and 10 MHz. Preferably the sampling frequency of the ADC is an integer factor larger than the frequency of the digital pulse train, and furthermore it is advantageous if the phases of the two sampling frequencies are synchronized. According to a specific variation of the invention this is achieved by using the same clock to generate the pulse train and control the sampling frequency of the ADC, whereby the required processing resources and cost can be minimized.

The digital pulse train used to control the microphone sensitivity provides an amplitude modulation of the electrical input signal provided by the microphone, wherein the amplitude modulation reflects the pulse train characteristics. The frequency of the amplitude modulations is significantly higher than the generally accepted standard range of audible frequencies for humans, which is the range between say 20 Hz to 20 kHz and consequently the amplitude modulations can subsequently be removed by low-pass filtering without noticeable deterioration of the resulting sound quality. Typically the low-pass filtering is carried out in the digital domain, i.e. after the analog-digital conversion, but in a variation an analog low-pass filter may also be positioned between the microphone and the ADC.

According to a variation of the present embodiment the low-pass filtering of the digital input signal is provided as part of down-sampling the digital input signal to a sampling frequency in the range between 20 kHz and 40 kHz prior to being processed by the filter bank and/or the digital signal processor, favored because a down sampled signal provides savings in the processing resources required by the filter bank and the digital signal processor, but in variations any type of digital low-pass filtering may be applied.

According to another variation the digital pulse train used to control the microphone sensitivity is filtered by an analog low pass filter before being provided to the microphone, in case the microphone is designed for an analog control signal, whereby the digital input signal no longer needs to be low-pass filtered.

According to yet another variation the low-pass filtering of the digital input signal is provided automatically by the output transducer as a consequence of its low-pass characteristic.

The digital pulse train used to control the microphone attenuation may be encoded in a variety of different manners. However, since the shape of the digital pulse train is superimposed onto the shape of the electrical signal provided by the microphone it is required that the digital pulse train provides a suitable amplitude modulation of the microphone signal. Consequently the digital pulse train used to control the microphone attenuation is encoded using a method selected from a group of methods comprising at least sigma-delta modulation, since this method provides a pulse density modulation (PDM) of the digital pulse train in a very processing efficient manner. However, in variations a PDM pulse train may be provided using other methods than sigma-delta modulation, all of which will be well known for a person skilled in the art. As opposed to PDM pulse trains a digital pulse train encoded to represent a binary value corresponding to a sampled value of the input signal that the pulse train is encoded to represent is not preferred for the present invention. This type of encoding is often denoted pulse code modulation (PCM).

According to the first embodiment the reduction of the microphone sensitivity is relinquished and the normal microphone sensitivity re-established as soon as the estimated input signal level falls below a second threshold level, wherein the second threshold level is the magnitude of the reduced microphone sensitivity lower than the first threshold level.

In variations the second threshold level is selected to be lower than the first threshold level by the magnitude of the reduced microphone sensitivity plus a constant selected from the range between zero and 20 dB or from the range between 0.5 dB and 5 dB such as 2 dB. It is advantageous to add a non-zero constant because this introduces a hysteresis effect that prevents too frequent switching between applying and not applying the microphone sensitivity reduction.

According to another variation the reduction of the microphone sensitivity is initiated by a sound classification indicating that the current sound environment is characterized by a generally high sound pressure level. A cocktail party or similar gatherings of many people are examples of such types of sound environment. This variation may be advantageous because the reduction of the microphone sensitivity may be initiated at relatively low sound pressure levels, whereby the reduction of microphone sensitivity may be carried out in small incremental steps that will tend to exhibit fewer sound artefacts (i.e. the slow and continuous adjustment already disclosed above).

Figure 2:
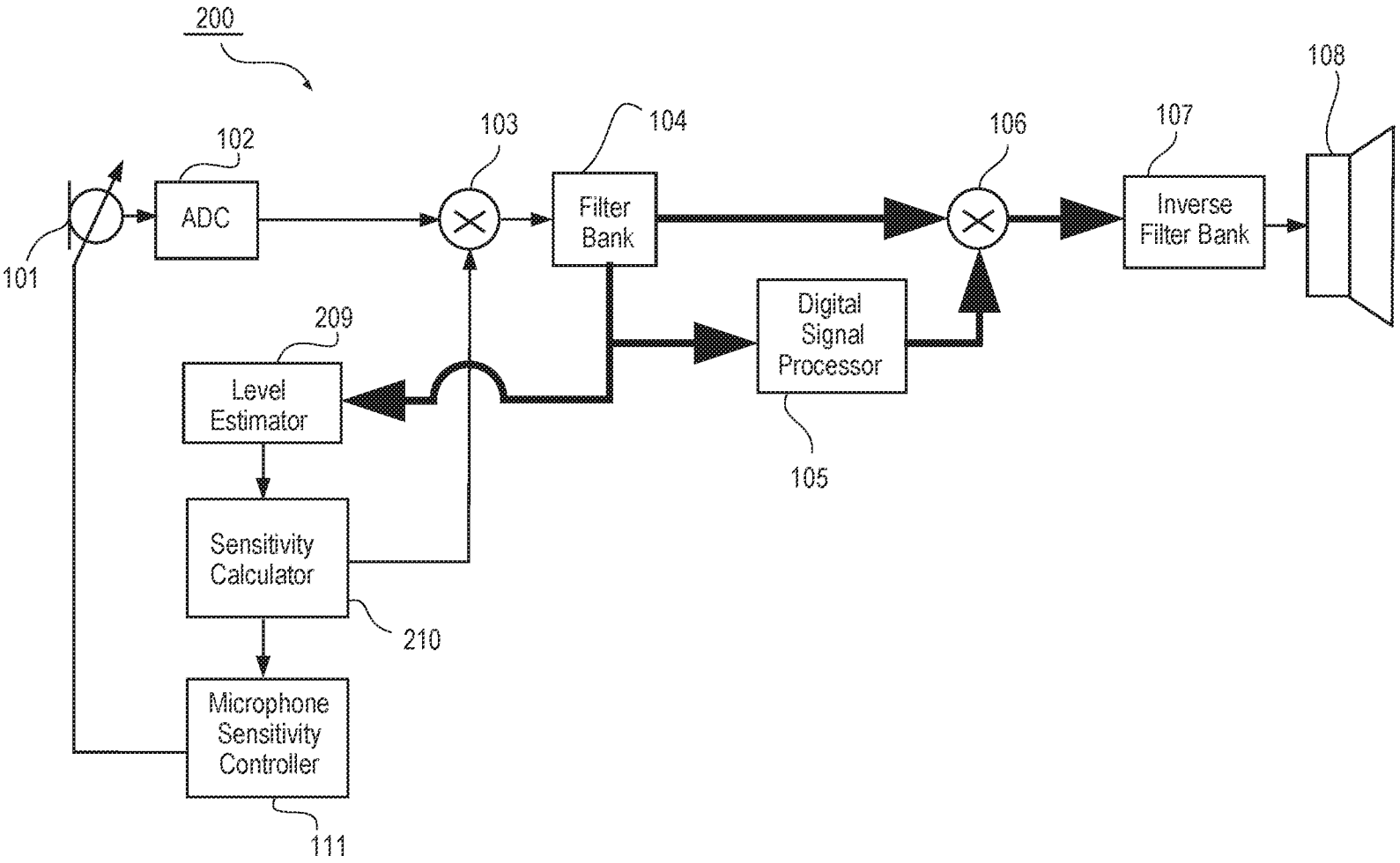
FIG. 2 illustrates highly schematically a hearing aid system according to a second embodiment of the invention.

Reference is now made to FIG. 2, which illustrates highly schematically a hearing aid system 200 according to a second embodiment of the invention. The hearing aid system 200 is similar to the hearing aid system of FIG. 1 except for the fact that the level estimator 209 receives as input the frequency band signals provided by the filter bank 104 and provides to the sensitivity calculator 210 a plurality of frequency band level estimates or some level estimate derived from said plurality of frequency band level estimates.

Hereby more advanced concepts for determining when to reduce the input transducer sensitivity can be used such that an optimum compromise can be reached with respect to, on one hand, the desire to initiate the reduction of the input transducer sensitivity at relatively low sound input levels in order to reduce the amount of sound artefacts and, on the other hand, the desire to postpone the reduction of the input transducer sensitivity to relatively high sound input levels in order to avoid a possible loss of signal to noise ratio due to the fact that the internal microphone noise level is independent of the reduced microphone sensitivity while the input signal level is reduced in correspondence with the reduced input transducer sensitivity.

It is noted that according to the embodiment of FIG. 2 the compensation gain applied by the first gain multiplier 103 is positioned before the frequency band levels are estimated by the level estimator 209. However, because the level estimation is done after the compensation gain is applied, the estimated level always represents the ambient sound pressure as opposed to the FIG. 1 embodiments where the estimated signal level includes the reduced microphone sensitivity. Generally it is not essential whether the compensation gain is applied before or after the input signal level is estimated, but it obviously has an effect on the criteria and threshold levels used by the sensitivity calculator as the skilled person will immediately realize.

In yet another variation of the disclosed embodiments the hearing aid system comprises a first plurality of microphones, where at least a second plurality of said microphones provide input signals that are processed in accordance with the present invention before the processed input signals are provided to e.g. a beam former.

Figure 3:
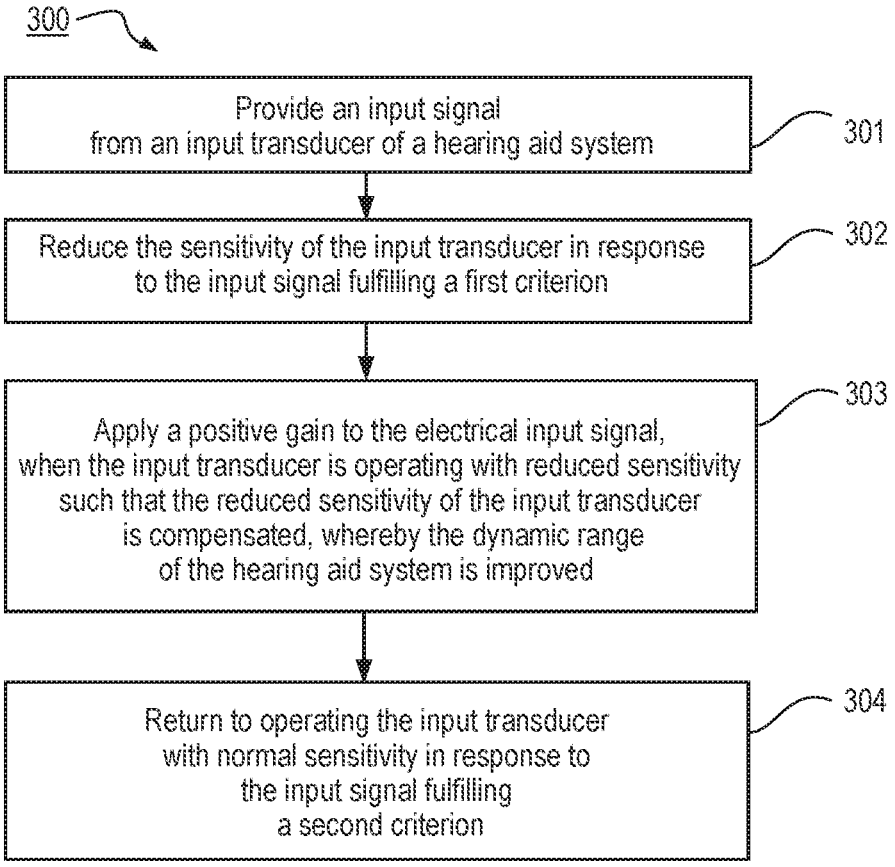
FIG. 3 illustrates highly schematically a method of operating a hearing aid system according to an embodiment of the invention.

Reference is now made to FIG. 3, which illustrates highly schematically a method of operating a hearing aid system according to an embodiment of the invention.

The method comprises the steps of:

providing, in a first step 301, an input signal from an input transducer of a hearing aid system;

reducing, in a second step 302, the sensitivity of the input transducer in response to the input signal fulfilling a first criterion;

applying, in a third step 303, a positive gain to the input signal, when the input transducer is operating with reduced sensitivity such that the reduced sensitivity of the input transducer is compensated, whereby the dynamic range of the hearing aid system is improved; and returning, in a fourth step 304, to operating the input transducer with normal sensitivity in response to the input signal fulfilling a second criterion.

According to still other variations, the present invention may be implemented in any audio device comprising an acoustical-electrical input transducer and an output transducer adapted to provide a perception of audio in a human being. Head-sets, personal sound amplifiers and smart phones are examples of such audio devices.

According to yet other variations the hearing aid system needs not comprise a traditional loudspeaker as output transducer. Examples of hearing aid systems that do not comprise a traditional loudspeaker are cochlear implants, implantable middle ear hearing devices (IMEHD), bone-anchored hearing aids (BAHA) and various other electromechanical transducer based solutions.

The invention claimed is:

1. A method of operating a hearing aid system comprising the steps of:

providing an input signal from an input transducer;

reducing the sensitivity of the input transducer in response to the input signal fulfilling a first criterion;

applying a positive gain to the input signal, in coordination with the acoustical-electrical input transducer is operating with reduced sensitivity, such that the reduced sensitivity of the input transducer is compensated, whereby the dynamic range of the hearing aid system is improved; and returning to operating the input transducer with normal sensitivity and removing said positive gain in response to the input signal fulfilling a second criterion.

2. The method according to claim 1, wherein the step of reducing the sensitivity of the input transducer comprises the steps of:

estimating a level of the input signal, hereby providing an estimated input signal level;

reducing the sensitivity of the input transducer in accordance with a predetermined or adaptive relationship between the estimated input signal level and the magnitude of the reduction of the input transducer sensitivity.

3. The method according to claim 1, wherein the step of reducing the sensitivity of the input transducer comprises the steps of:

estimating a level of the input signal, hereby providing an estimated input signal level; and reducing the sensitivity of the input transducer in response to the estimated input signal level exceeding a first threshold level.

4. The method according to claim 3, wherein the first threshold level is selected from a range between 0.5 dB and 5 dB below a maximum of the input signal level, wherein the maximum of the input signal level is determined by the dynamic range and/or saturation level of the input transducer or of an analog-to-digital converter adapted to convert the input signal.

5. The method according to claim 1, wherein the step of returning to operating the input transducer with normal sensitivity in response to the input signal fulfilling a second criterion comprises the steps of:

estimating a level of the input signal, hereby providing an estimated input signal level; and returning to operating the input transducer with normal sensitivity in response to the estimated input signal level no longer exceeding a second threshold level, wherein the second threshold level is selected to be lower than the first threshold level in order to introduce a hysteresis effect.

6. The method according to claim 1, wherein the step of applying the positive gain is carried out on a digital input signal provided by an analog to digital conversion of the input signal before processing adapted to relieve a hearing deficit of an individual user is carried out.

7. The method according to claim 1, wherein the input transducer is a capacitive microphone, and wherein the step of reducing the sensitivity of the input transducer comprises the step of:

reducing the polarization voltage of the capacitive microphone.

8. The method according to claim 1, wherein the step of reducing the sensitivity of the input transducer comprises the steps of:

providing an input transducer wherein the reduction of the sensitivity is implemented as either on or off; and using a pulse density modulated digital signal to provide a control signal for the input transducer, whereby the sensitivity of the input transducer may be adjusted with a higher resolution.

9. A hearing aid system comprising:

an input transducer with adjustable sensitivity, a signal level estimator adapted to provide a level estimate of an input signal provided by the input transducer;

a sensitivity calculator adapted to determine a magnitude of a reduction in input transducer sensitivity in accordance with a pre-determined or adaptive relationship between the estimated input signal level and the magnitude of the reduction of input transducer sensitivity, and adapted to determine a positive gain to be applied to the input signal in order to compensate the determined reduction in input transducer sensitivity;

a gain multiplier adapted to apply the positive gain to the input signal; and an input transducer sensitivity controller adapted to control the adjustable sensitivity of the input transducer in accordance with the determined magnitude of the reduction input transducer sensitivity.

10. The hearing aid system according to claim 9, wherein the sensitivity calculator is further adapted to reduce the sensitivity of the input transducer in response to the estimated input signal level exceeding a first threshold level.

11. The hearing aid system according to claim 9, wherein the input transducer provides an adjustable sensitivity with a resolution that is only one bit; and the input transducer sensitivity controller is adapted to use a pulse density modulated digital signal to provide a control signal for the input transducer, whereby the sensitivity of the input transducer may be adjusted with a higher resolution.

12. A non-transitory computer-readable medium storing instructions thereon, which when executed by a computer perform the following method:

providing an input signal from an input transducer;

reducing the sensitivity of the input transducer in response to the input signal fulfilling a first criterion;

applying a positive gain to the input signal, in coordination with the acoustical-electrical input transducer operating with reduced sensitivity, such that the reduced sensitivity of the input transducer is compensated, whereby the dynamic range of the hearing aid system is improved; and returning to operating the input transducer with normal sensitivity and removing said positive gain in response to the input signal fulfilling a second criterion.

13. The computer-readable medium according to claim 12, wherein said step of reducing the sensitivity of the input transducer comprises the steps of:

providing an input transducer wherein the reduction of the sensitivity is implemented as either on or off; and using a pulse density modulated digital signal to provide a control signal for the input transducer, whereby the sensitivity of the input transducer may be adjusted with a higher resolution.

14. The method according to claim 1, wherein the first and second criteria are different.

15. The method according to claim 14, wherein said first criterion is the input signal being above a first level, and said second criterion is said input signal being below a second level different from said first level.

16. The computer-readable medium according to claim 12, wherein the first and second criteria are different.

17. The computer-readable medium according to claim 16, wherein said first criterion is the input signal being above a first level, and said second criterion is said input signal being below a second level different from said first level.

18. The method according to claim 2, wherein the adaptive relationship comprises an adaptive threshold level configured such that a lower threshold level may be selected in response to a detection of a sound environment characterized by a generally high sound pressure level, whereby the risk of sound artefacts may be minimized because the reduction of the microphone sensitivity may be initiated at relatively low sound pressure levels, whereby the reduction of microphone sensitivity may be carried out in small incremental steps.

19. The method according to claim 1, wherein the step of reducing the sensitivity of the input transducer in response to the input signal fulfilling a first criterion comprises the steps of:

reducing the microphone sensitivity in small incremental steps in response to the input signal level exceeding an adaptive threshold level.

20. The method according to claim 2, wherein the estimated input signal level is a frequency band level estimate.

* * * * *